United States Patent [19]

Uchino

[11] Patent Number: 4,764,150

[45] Date of Patent: Aug. 16, 1988

[54] RUNNING TOY

[75] Inventor: Shigeo Uchino, Tokyo, Japan

[73] Assignee: Kabushiki Kaisha Uchino Shoten, Tokyo, Japan

[21] Appl. No.: 44,980

[22] Filed: Apr. 30, 1987

[51] Int. Cl.[4] ..... A63H 30/04; A63H 17/00

[52] U.S. Cl. ..... 446/456; 446/462; 446/460

[58] Field of Search ..... 446/462, 484, 456, 90, 446/95, 460, 437, 91, 93, 94, 454, 455

[56] References Cited

U.S. PATENT DOCUMENTS 3,041,485 6/1962 Jolley ..... 446/462 X 4,406,085 9/1983 Rhodes ..... 446/456

FOREIGN PATENT DOCUMENTS 2498468 7/1982 France ..... 446/456

*Primary Examiner*—Mickey Yu

*Attorney, Agent, or Firm*—Michael J. Striker

[57] ABSTRACT

This invention divides into blocks element parts of a running toy of radio control system so as to make easy repairing or setting up. The running toy is composed of a drive unit part of rear wheels, an electronic component unit part for running control, a steering unit part of front wheels, a battery housing unit part, a chassis for supporting said unit parts, and a body of the running toy. The unit parts are divided into blocks, and the body is provided with socket parts in correspondence to disposing positions of said block parts, and the sockets parts are connected electrically and connected to said block parts detachably.

9 Claims, 2 Drawing Sheets

RUNNING TOY

BACKGROUND OF THE INVENTION 1. (Field of the Invention)

The present invention relates to a self-running toy, and more particularly to a running toy of a radio control system where mechanisms, electronic circuit and others are housed and are divided into blocks for easy repairing, exchanging or setting up.

2. (Description of the Prior Art)

Known is a running toy car which is incorporated with a receiver and is controlled in back and forth goings or left and right turnings, that is, a so-called running toy of a radio control system.

Since such a running toy is housed with a precise electronic circuit, complicated steering mechanism and drive mechanism, it more often gets out of order if it is effected with abrupt shocks or changes in temperature. Those inferior or condemned articles are returned from retail shops to makers, and after repairing and packing they are again sent out to the shops. In this respect, costs associated with for transferring, packing and man labor is high and makes the radio control toy expensive as a consequence. The complicated interior structure makes setting-up troublesome, and production cost is high per se.

In view of the above mentioned circumstances, the inventor studied existing articles, and found that bad causes for the problems are as follows:

1. Steering part of front wheels
   Turning cannot be changed because of collison with obstacles during driving.
2. Drive part of rear wheels
   A gear is broken by suddenly switching the forth or back running. A brush of a motor is exhausted and the motor is not rotated.
3. Battery case part
   Rusts appear on a contact plate by leakage of cell. Poor contact is between a lead wire and the contact plate.
4. Electronic circuit part
   Bad contact.

Blocking of the running toys are taught in Utility Model Publication 56-31272 and same publication 57-14877.

The former makes a block of an electronic control part of a radio control car for simplifying the setting-up, changing and checking of the control circuit. This arrangement is useful to trouble shoot the control circuit part, but could not be applied to other parts out of order as in the steering or drive mechanisms.

The latter divides an entire toy into blocks, and each of the blocks is connected by a magnet and has a core for providing conductivity between the blocks. However, since the running toys are given big shocks by collison with others, each of the blocks must be firmly connected to the other when the whole toy is separated. Therefore, the connection by the magnet must overcome problems about strength.

This invention has been proposed from viewpoints of the above said conditions and as a result of studies.

SUMMARY OF THE INVENTION

It is a first object of the invention to divide element parts of the running toy into a plurality of blocks, so that each of the blocks may be connected to a socket part by a plug-in system. Thus, repairing is made easy by only exchanging a block out of order. If a bad part was not found, it would be sufficient to exchange the blocks in succession and confirm that the work was satisfactory without requiring specialized knowledge.

It is a second object of the invention to provide a running toy of radio control system which withstands external shocks, such as collisions, by said division into the blocks.

It is a third object of the invention to save costs for returning damaged articles to the makers. Instead of returning bad articles to the maker, retail shops repair them with spares of the blocks kept in the shops, and charges to be taken for returning may be largely saved.

It is a fourth object of the invention to simplify the setting-up process in a factory and reduce the production cost or selling cost by blocking the element part of the running toy.

Other objects of the invention will be apparent from embodiment to be explained of the invention.

DESCRIPTION OF PREFERRED EMBODIMENT OF THE INVENTION

An embodiment of the invention will be explained with reference to the attached drawings.

Figure 1:
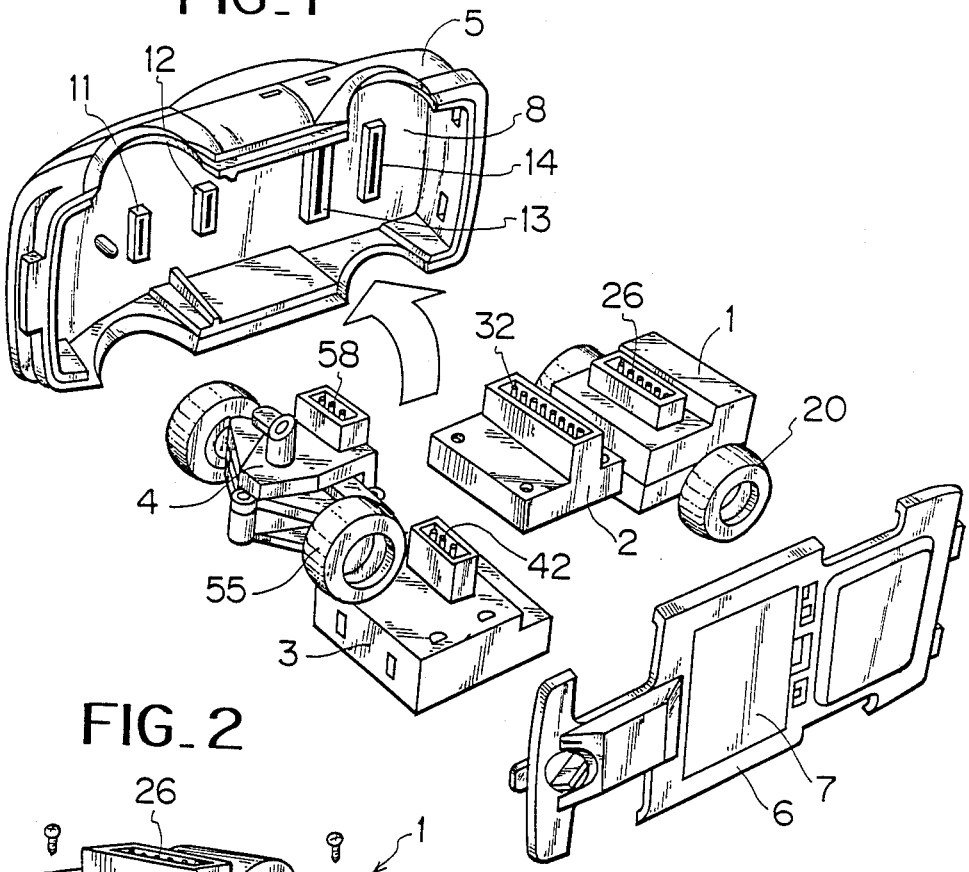
FIG. 1 is a perspective view showing one embodiment of the invention.

In FIG. 1, four unit blocks are shown: a drive unit block 1 of rear wheels, a block 2 housing an electronic component unit, a block 3 housing a battery, and a steering unit block 4 of front wheels. These blocks are housed within a body 5 and supported by a chassis 6 from a bottom.

Figure 2:
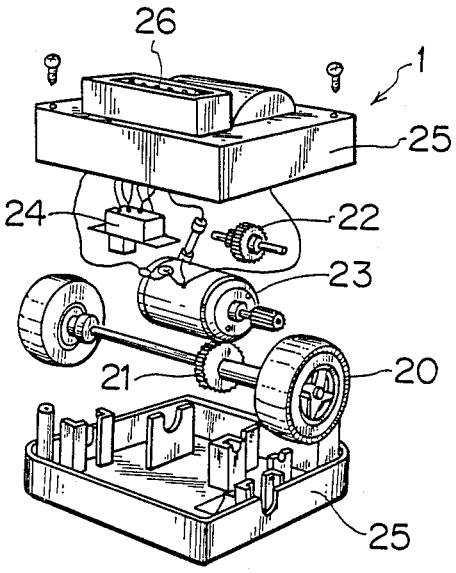
FIG. 2 is a perspective view showing a drive unit part of rear wheels.

The rear wheel drive unit block 1 is, as shown in FIG. 2, composed of rear wheels 20, speed reduction gears 21, 22, a motor 23 and a switch 24. These members are housed in an upper and a lower casings 25, 25, and terminals of wirings to be connected to the motor 23 and the switch 24 are connected to plugs 26 projecting in parallel on the upper casing 25.

Figure 3:
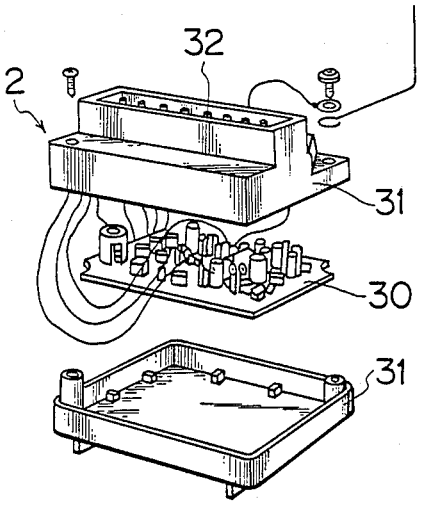
FIG. 3 is a perspective view showing an electronic component part.

The electronic component unit block 2 is, as illustrated in FIG. 3, an upper and a lower casings 31, 31 incorporated with electronic components on a print board 30, and has a receiving circuit for a transmitter, a control circuit which, in response to a received signal, controls a turning direction and rotation speed of the motor 23, and a control circuit for sending a steering signal to a steering mechanism.

Terminals of these wirings are connected to plugs 32 projecting on the upper casing 31.

Figure 4:
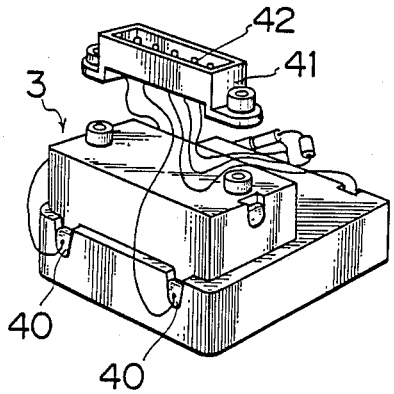
FIG. 4 is a perspective view showing a battery housing unit part.

The battery housing unit block 3 is a box shaped casing for housing a battery as seen in FIG. 4, and the casing is opened at its lower face. This opened part corresponds to an opening cover (see FIG. 1) of the chassis 6, and the battery is housed through the opening cover. Terminals of the wirings connected to contacts 40 to the battery are connected to plugs 42 of a plug case 41 fixed to the casing by screws.

Figure 5:
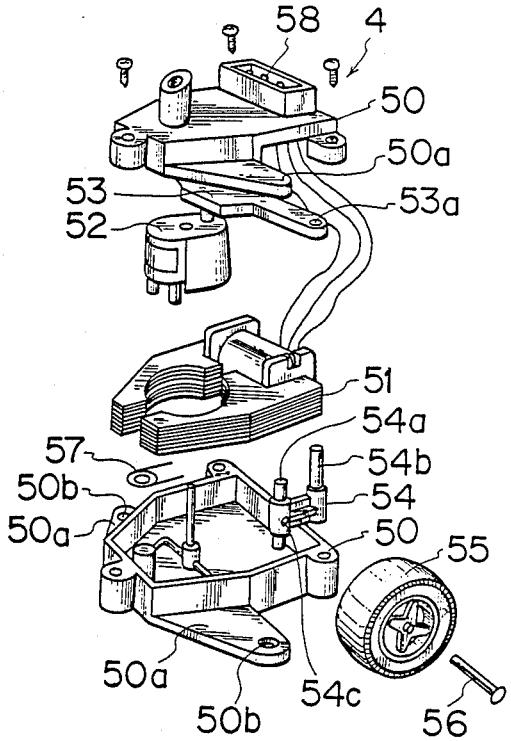
FIG. 5 is a perspective view showing a steering unit part of front wheels.

The steering unit block 4 is, as seen in FIG. 5, housed with an electromagnetic coil 51, a core 52 and an arm 53 within the upper and lower casings.

A bearing member 54 of the front wheels has a pin 54*a* extending in an upper and a lower directions and a pin 54*b* extending in the upper direction. A pin 56 passes through a center of the front wheel 55, and is inserted into a hole 54*c* of the bearing member 54, so that the front wheels are rotatably mounted on the bearing member 54.

The pin 54*a* of the bearing member 54 is inserted between grooves 50*b* formed in projected parts 50*a*, 50*a* of an upper and a lower casings 50, 50 (a groove 50*b* of the upper casing is not shown), and the pin 54*b* is inserted into the hole 53*a* of an arm 53.

The core 52 is turned in the left or right direction by energization from the electromagnetic coil 51, and the arm 53 is moved in the left or right direction in association with said turning so as to turn the front wheels 55 in the left or right direction via the bearing member 54.

In FIG. 5, only one side of the front wheels is shown, but the other is also provided to the steering unit block 4 by the same mechanism. The numeral 57 is a pin for giving elasticity to the turning direction of the core 54.

Terminals of the wirings of the steering unit are connected to the plugs 58 projecting in parallel from the surface of the upper casing 50.

In the present embodiment, the body 5 is furnished with an inner frame 8 therewithin fixedly or detachably, and the inner frame 8 is provided with sockets 11, 12, 13, 14 corresponding to the parts supporting the blocks.

Figure 6:
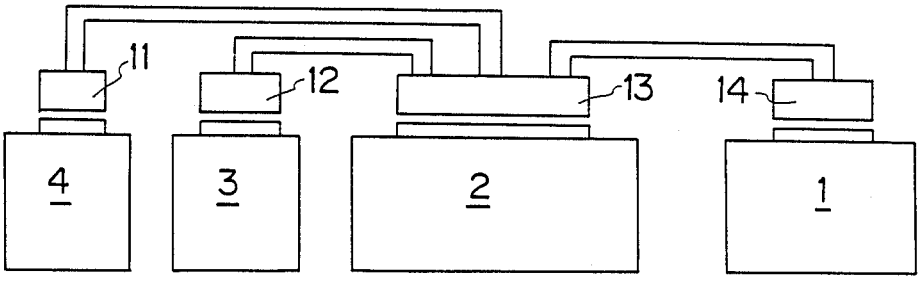
FIG. 6 is a schematic view showing connection between socket parts and plug parts of the blocks.

These sockets 11 to 14 are provided with contacts to said plugs. As shown in FIG. 6 in which electronic component unit block 2 electrically connects the rest of the blocks 1, 3 and 4, the contacts between the sockets are electrically connected. These wirings are disposed at the inner side of the frame 8 of the body 5.

In the present invention, the plugs 26, 32, 42, 58 of the blocks 1 to 4 are inserted into the sockets 11 to 14, and the chassis 6 is attached to the body 5, so that the blocks are pushed from the lower side to secure the plugs and the sockets. It would be convenient to distinguish the sockets by changing the sizes of the connecting portions or coloring them such that this socket receives only this corresponding plug.

The above mentioned embodiment is one example of this invention, and changings of the unit mechanisms of the blocks and the shape of the body are arbitrary. Not only four wheel car is proposed but also a six wheel car may be proposed by providing idling wheels between the front and rear wheels. Further, said composing members are applied to not only the radio control system but to other electric running toys. Following the subject matters of the invention, the detailed structure may be changed at disposal.

According to the invention, the element parts of the running toy are divided into the blocks, and as each of the blocks may be easily attached to the socket by the plug-in system, the part out of order may be easily repaired by only exchanging it. If a bad part were not found, it would be repaired without the professional knowledge by exchanging the four block parts successively. Therefore, if spares of the respective block parts are kept in the shops, the affected parts may be repaired there, not returning it to the maker, and the charges to be taken to returning are saved. In addition, the setting-up process is simplified, and the production and selling costs can be reduced.

The four parts are rationally made into blocks according to studies indicate which spots on the running toy are easily damaged so that almost all of the problems may be dealt with. The block parts are protected by the body and pushed by the chassis, and the block parts do not get out of place from shocks such as collisions.

What is claimed is:

1. A self-running toy, comprising:
electronic control unit means;
drive unit means responsive to said electronic control unit means for driving the toy;
steering unit means responsive to said electronic control unit means for steering the toy;
power supply housing unit means formed to accomodate a power supply for powering the toy;
a chassis detachably supporting all of said unit means;
means for protecting all of said unit means and including a body housing all of said unit means on said chassis; and
connecting means for detachably connecting each of said unit means to said body, each of said unit means being formed as a separate block, said connecting means including a plurality of interengaging pairs of mechanical members and of electrical members, said interengaging pairs being arranged between each of said unit means and said body, said mechanical members detachably mating with each other, said electrical members electrically connecting with each other when said mechanical members detachably mate with each other.

2. The self-running toy as defined in claim 1, wherein said body has an inner side; and further comprising an inner frame fixed to said inner side, at least one of both said mechanical members and said electrical members of each of said interengaging pairs being formed on said inner frame, said inner frame having an inner side, said electrical members being wired together on said inner side of said inner frame.

3. The self-running toy as defined in claim 1, wherein at least one of said unit means includes a casing with an upper portion formed with at least one of both said mechanical members and said electrical members of each of said interengaging pairs.

4. The self-running toy as defined in claim 3, wherein said drive unit means includes said at least one casing, rear wheels, a motor, speed reduction gear means, and switch means, said at least one casing housing all of said motor, said speed reduction gear means, and said switch means, said rear wheels being drivably connected to said motor.

5. The self-running toy as defined in claim 3, wherein said electronic control unit means includes a printed circuit board with a receiving circuit for receiving a transmitted signal and a controlling circuit for controlling both said drive unit means and said steering unit means in response to said receiving circuit, said electronic control unit means further including said at least one casing housing said printed circuit board.

6. The self-running toy as defined in claim 3, wherein said power supply means includes said at least one casing, said at least one casing being box-shaped and formed for housing a battery, said chassis and said at least one casing each having an opening through which the battery is insertable and removable.

7. The self-running toy as defined in claim 3, wherein said electronic control unit means includes a control circuit which provides a signal for steering said steering unit means, said steering unit means including said at least one casing, said steering unit means further including front wheels and means for steering said front wheels in response to the signal from said electronic control unit means, said at least one casing housing said front wheels and said steering means.

8. The self-running toy as defined in claim 1, wherein each of said electrical members are electrically connected to each other so that said electronic control unit means is electrically connected with all the rest of said unit means.

9. The self-running toy as defined in claim 1, wherein said interengaging pairs are formed as interengaging sockets and plugs.

* * * * *